US008215388B2

(12) United States Patent
van Zuilekom et al.

(10) Patent No.: US 8,215,388 B2
(45) Date of Patent: Jul. 10, 2012

(54) SEPARATOR FOR DOWNHOLE MEASURING AND METHOD THEREFOR

(75) Inventors: Anthony H. van Zuilekom, Houston, TX (US); Mark A. Proett, Houston, TX (US); Ronald E. Cherry, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 400 days.

(21) Appl. No.: 12/526,716

(22) PCT Filed: Mar. 19, 2007

(86) PCT No.: PCT/US2007/006821

§ 371 (c)(1),
(2), (4) Date: Dec. 1, 2009

(87) PCT Pub. No.: WO2008/115178

PCT Pub. Date: Sep. 25, 2008

(65) Prior Publication Data

US 2010/0089569 A1 Apr. 15, 2010

(51) Int. Cl.
*E21B 49/10* (2006.01)

(52) U.S. Cl. ..... 166/264; 166/166

(58) Field of Classification Search ..... 166/162, 166/166, 250.01, 264, 66, 105.5; 73/152.23, 73/152.24

See application file for complete search history.

(56) References Cited

U.S. PATENT DOCUMENTS

| | | | | |
|---|---|---|---|---|
| 3,530,711 | A * | 9/1970 | Tocanne | 73/152.23 |
| 4,739,654 | A | 4/1988 | Pilkington et al. | |
| 5,147,561 | A | 9/1992 | Burge et al. | |
| 6,212,948 | B1 * | 4/2001 | Ekdahl et al. | 73/152.18 |
| 6,670,605 | B1 | 12/2003 | Storm, Jr. et al. | |
| 7,195,063 | B2 * | 3/2007 | Nogueira et al. | 166/264 |
| 7,665,519 | B2 * | 2/2010 | Oddie | 166/264 |
| 2005/0028973 | A1 | 2/2005 | Paluch et al. | |
| 2005/0205256 | A1 | 9/2005 | DiFoggio | |

FOREIGN PATENT DOCUMENTS

| | | |
|---|---|---|
| GB | 2384508 | 7/2003 |
| GB | 2417913 | 3/2006 |
| GB | 2433273 | 6/2007 |
| WO | WO-0198630 A1 | 12/2001 |
| WO | WO-2008115178 A1 | 9/2008 |

OTHER PUBLICATIONS

"Australian Application Serial No. 2007349290, First Examiner's Report mailed Jun. 30, 2010", 2 pgs.
"Australian Application Serial No. 2007349290, Response filed Jan. 20, 2011 to First Examiner's Report dated Jun. 30, 2010", 9 pgs.
"International Application Serial No. PCT/US2007/006821, International Search Report mailed Dec. 7, 2007", 4 pgs.
"International Application Serial No. PCT/US2007/006821, Written Opinion mailed Dec. 7, 2007", 6 pgs.

* cited by examiner

*Primary Examiner* — David Andrews
(74) *Attorney, Agent, or Firm* — Schwegman, Lundberg & Woessner, P.A.

(57) ABSTRACT

A separator for downhole measuring during sampling in a subterranean formation. The separator allows for mixed fluid phases to be separated while flowing formation fluid therethrough.

23 Claims, 5 Drawing Sheets

SEPARATOR FOR DOWNHOLE MEASURING AND METHOD THEREFOR

RELATED APPLICATION

This application is a nationalization under 35 U.S.C. 371 of PCT/US2007/006821, filed Mar. 19, 2007 and published as WO 2008/115178 A1, on Sep. 25, 2008; which application and publication are incorporated herein by reference in their entirety and made a part hereof.

TECHNICAL FIELD

The application relates generally to a separator for downhole measuring and sampling.

BACKGROUND

In a down hole fluid sampling process, the primary objective is to obtain or identify formation samples representative of true, for example, clean formation fluid or native fluid with a low contamination level of borehole fluids or drilling fluids.

The level of acceptable contamination may be limited by many factors such as geographical location, permeability, fluid viscosity, borehole stability, invasion, sampling difficulties, and economics. One of the primary limiting factors occurs when attempting to sample multiphase fluids. In the case of oil and water or gas and oil, the two phases are not fully mixed and may flow at different rates in a sampling tool. This leads to misleading results from downhole fluid identification sensors and highly contaminated samples.

What is needed is a measuring device that will allow measurement and identification of various phases of the formation fluid and response of the formation sample under various conditions. What is further needed is a way to retrieve a more representative and less contaminated sample in a faster period of time.

BRIEF DESCRIPTION OF THE DRAWINGS

Embodiments of the invention may be best understood by referring to the following description and accompanying drawings which illustrate such embodiments. The reference numbers are the same for those elements that are the same or similar across different Figures. In the drawings.

DETAILED DESCRIPTION

Figure 1:
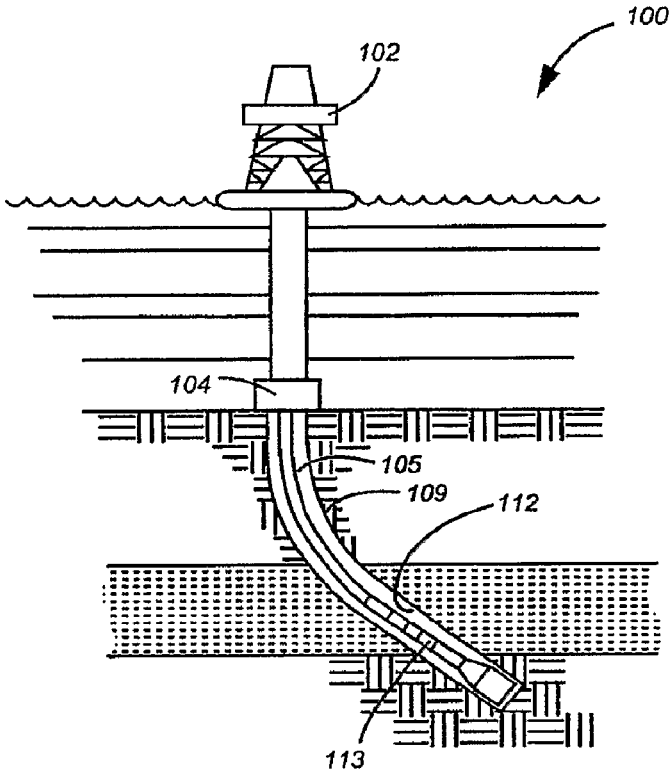
FIG. 1 illustrates a system for drilling operations, according to at least one embodiment.

In the following description of some embodiments of the present invention, reference is made to the accompanying drawings which form a part hereof, and in which are shown, by way of illustration, specific embodiments of the present invention which may be practiced. In the drawings, like numerals describe substantially similar components throughout the several views. These embodiments are described in sufficient detail to enable those skilled in the art to practice the present invention. Other embodiments may be utilized and structural, logical, and electrical changes may be made without departing from the scope of the present invention. The following detailed description is not to be taken in a limiting sense, and the scope of the present invention is defined only by the appended claims, along with the full scope of equivalents to which such claims are entitled.

A downhole separator apparatus and method for making downhole measurements in a logging or drilling environment is provided herein. A downhole separator can be placed in the flowline of downhole sampling tools. The downhole separators separates the fluid phases that, for example, either the heavier or lighter fluid can be samples. Generally, the contamination is the heavier phase, and if the two fluids can be separated, the clean up process is achieved much more quickly. Alternatively, the heavier fluid may be desired fluid, such as in water sampling, and the heavier fluid can be selected for sampling.

FIG. 1 illustrates a system 100 for drilling operations. The system 100 includes a drilling rig 102 located at a surface 104 of a well. The drilling rig 102 provides support for a drill string 105. The drill string 105 penetrates a rotary table for drilling a borehole 108 through subsurface formations 109. The downhole tool 113 may be any of a number of different types of tools including measurement-while-drilling ("MWD") tools, logging-while-drilling ("LWD") tools, etc. It should be noted the system 100 can be used with a wireline tool as well.

The downhole tool 113 includes, in various embodiments, one or a number of different downhole sensors, which monitor different downhole parameters and generate data that is stored within one or more different storage mediums within the downhole tool 113. The downhole tool 113 further includes a power source, such as a battery or generator. A generator could be powered either hydraulically or by the rotary power of the drill string. The generator could also be on the surface and the power supplied through conductor or conductors in a wireline or drillpipe.

Figure 2:
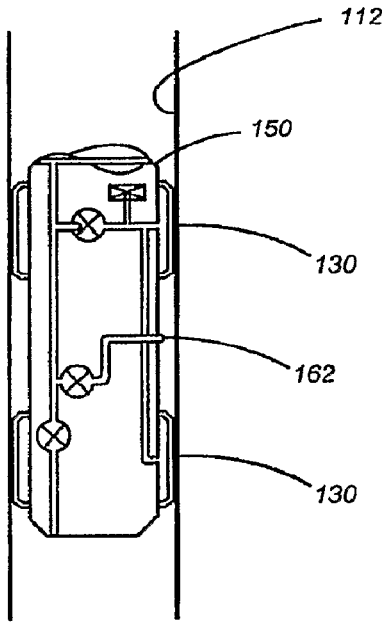
FIG. 2 illustrates a formation testing tool, according to at least one embodiment.

The downhole tool 113 includes a downhole sampling device such as a formation testing tool 150 (FIG. 2), which can be powered by power source. In an embodiment, the formation testing tool 150 (FIG. 2) may be mounted on a drill collar or wireline deployed. As shown in FIG. 2, the formation testing tool 150 engages the wall of the borehole 108 and extracts a sample of the fluid in the adjacent formation using, for example, a pump. As will be described later in greater detail, the formation testing tool 150 samples the formation and inserts fluid in a flow separator assembly. The flow separator assembly allows for mixed fluid phases to be separated while flowing formation fluid therethrough. This allows for the fluids that are sampled to be cleaned of impurities. The flow separator assembly optionally includes, but is not limited to, one or more of an open chamber separating fluids using gravity, a cyclone separator, or a centrifuge separator.

Figure 3:
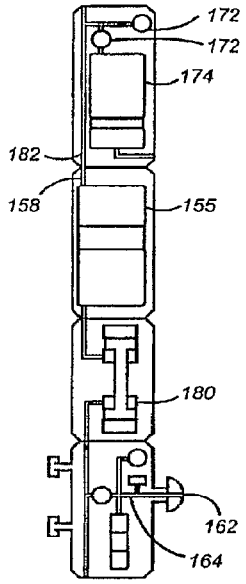
FIG. 3 illustrates a formation testing tool according to at least one embodiment.
Figure 4:
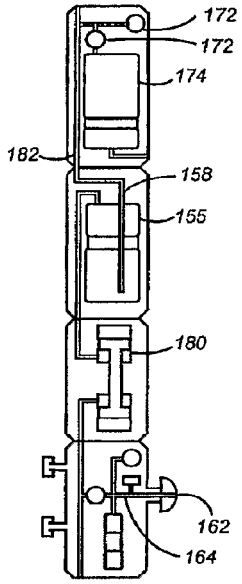
FIG. 4 illustrates a formation testing tool according to at least one embodiment.

FIG. 2 illustrates the formation testing tool 150 in position to retrieve subterranean formation fluid from the borehole 108. The formation testing tool 150 includes a packer 130, such as, but not limited to, a pad, an inflatable packer, an extendible packer, or an expandable packer. The at least one packer 130, including in an option, upper and lower packers, that contacts the wall of the borehole 108 isolating the borehole and seals out mud flowing in the bore. In an option, formation testing tool 150 includes a snorkel that extends into the formation to obtain formation fluid. The snorkel is, in an embodiment, is fluidly connected to a main sampling flowline 164. An inlet 162 draws fluid into the formation testing tool 150 and into the main sampling flowline 164. In an option, the inlet 162 draws fluid from between packers 130, for instance, as shown in FIG. 2. The flow separator assembly (FIG. 3) is communicatively, such as fluidly, coupled with the main sampling flowline 164.

FIGS. 3-8 illustrate various examples of the formation testing tool 150 in greater detail. The formation testing tool 150, as mentioned above, includes a inlet 162, a main sampling flowline 164 coupled with the inlet 162, and the flow separator assembly 155. The main sampling flowline 164 allows for fluids to be brought from the formation, via the inlet 162, to the flow separator assembly 155. A pump including an inlet and outlet can be used to allow the formation fluid to be extracted from the formation at various rates, where the fluid is directed through the formation testing tool 150.

The formation testing tool 150 further includes an exit flow line 158 communicatively coupled between the flow separator assembly 155 and at least one of a borehole 112 (FIG. 2) or a sample chamber 174. The formation testing tool 150 further includes one or more valves 172 operable to change between a first configuration to another configuration. In the first configuration, the valve operably connects the exit flow line 158 with the borehole (FIG. 2). In another option, in the second configuration, the one or more valves 172 operably connect the exit flow line 158 with a sample chamber 174.

Figure 5:
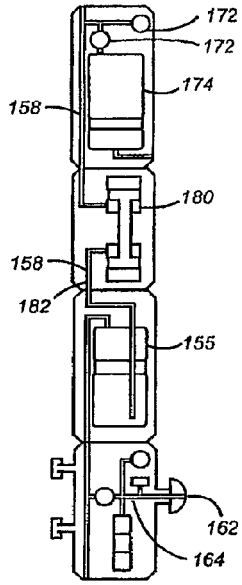
FIG. 5 illustrates a formation testing tool according to at least one embodiment.
Figure 6:
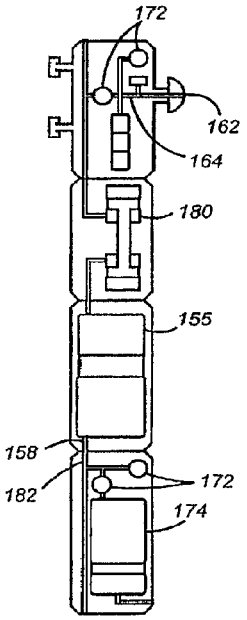
FIG. 6 illustrates a formation testing tool according to at least one embodiment.
Figure 7:
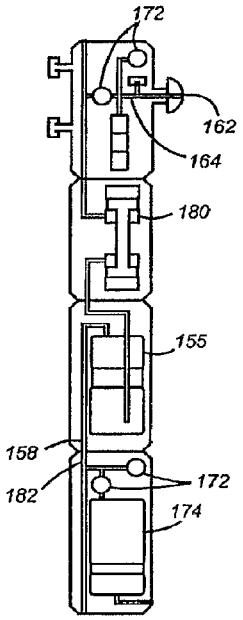
FIG. 7 illustrates a formation testing tool according to at least one embodiment.
Figure 8:
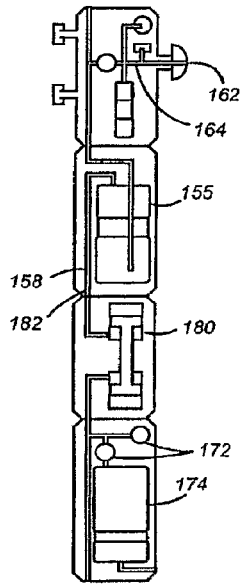
FIG. 8 illustrates a formation testing tool according to at least one embodiment.

One or more pumps 180 are used to draw fluid within the inlet 162 of the formation testing tool 150. It should be noted that devices other than pumps can be used to reduce the pressure and allow for formation fluid to be drawn within the formation testing tool 150. The pump 180 can be located between the main sampling flowline, such as the flowline inlet, and the flow separator assembly 155, as shown in FIGS. 3, 4, 6 and 7. In another option, the pump 180 can be located near or on the outlet of the flow separator assembly 155, as shown in FIGS. 5 and 8.

As fluids enter the flow separator assembly 155, the fluid phases will naturally separate with the lighter fluids on top. Fluid sensors 182 can be included in the formation testing tool and, optionally, can be placed on an outlet of the flow separator assembly 155 to measure fluid properties and identify the lighter fluid. In a further option, additional fluid sensors can be placed on the inlet side of the flow separator assembly 155 or in the flow separator assembly 155. When the sensors 182 determine the flow separator assembly 155 has accumulated a sufficient sample of uncontaminated formation fluids, the outlet of the flow separator assembly 155 can be directed to a sample chamber 174.

Figure 9:
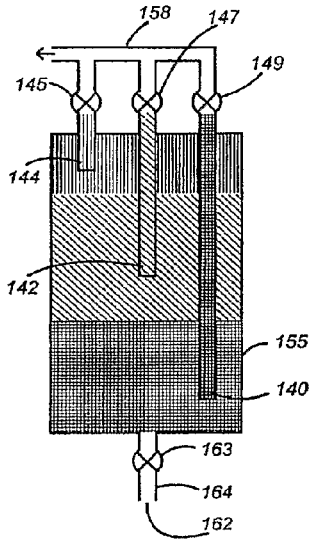
FIG. 9 illustrates a flow separator assembly according to at least one embodiment.
Figure 11:
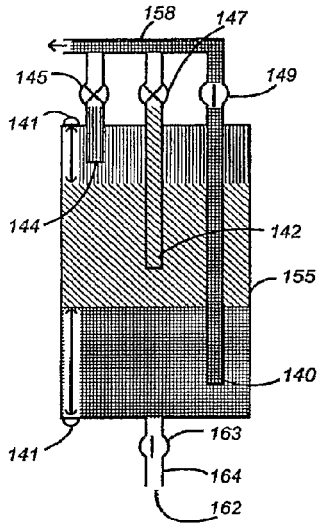
FIG. 11 illustrates a flow separator assembly according to at least one embodiment.
Figure 15:
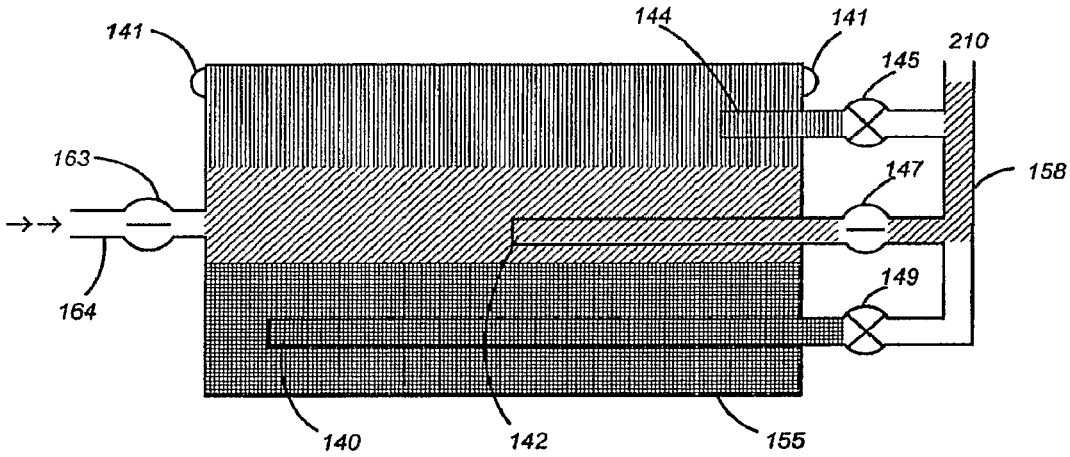
FIG. 15 illustrates a flow separator assembly according to at least one embodiment.

Further details and options of the flow separator assembly 155 can be seen in FIGS. 9-19. Referring to FIG. 9, the flow separator assembly 155 includes an inlet, such as a main sampling flowline 164. The flow separator assembly 155 receives fluid from the relatively small flow line, such as the flowline 164 to a larger cavity of the separator 155 that will allow the components of the fluid to separate while maintaining the desired pressure as set by an operator or a control system. As mentioned above, the location of the separator assembly 155 may be above or below a pumping module depending on the fluid properties or measurements required by the operation. One or more inlets 140, 142, 144 of the exit flow line 158 are controllable and allow for fluid to be drawing from various levels within the separator chamber. For instance, the one or more inlets 140, 142, 144 can be disposed at various depths within the flow separator 155. For example, the flow separator 155 includes a first inlet 140, and second inlet 142, and a third inlet 144 where the inlets have different depths within the chamber. Examples can be seen in FIGS. 9-15. Furthermore, the flow separator assembly 155 allows for horizontal sampling as well as vertical sampling. In another example, the first inlet has first depth in a first orientation, and a second depth in a second orientation, as shown in FIG. 15, where the flow separator assembly 155 of FIG. 15 allows for horizontal or high angle wells.

Valves 145, 147, 149 can be selectively opened to draw fluid from the various segregated portions of material within the flow separator assembly 155, and can be used to control the one or more inlets 140, 142, 144. Sensors 141 can be associated with the inlet or placed at any intervals or through the separators, and are capable of sensing or measuring one or more of properties, such as, but not limited to resistivity, capacitance, or acoustic properties. The sensor measurements may detect fluid segregation as well as fluid identification, and can be used in one or more of manual surface indications or uphole/downhole control systems. The sensors 141 can be used to trigger the valves 149 so that fluid or gas can be selectively removed from the chamber of the separator assembly 155 via the exit flow line 158.

An example of the sampling process is as follows. A valve 163 of the flow line 164 is opened, and the main sample flow line 164 allows fluid to flow therethrough and into the separator chamber. The fluid would be pumped at a rate that would allow the fluid to separate into the various components, and would exit the separator via inlet 140 and through exit line 158. The heavier fluid is retrieved via inlet 140, such as the water phase. The sensors may determine whether segregation has occurred by detection of various measured properties at different levels of the chamber. In a further option, external fluid identification sensor may determine properties regarding fluid exiting the exit line 158.

In an option, the main sample flow line 164 is located at a lower portion of the separator chamber. By drawing fluid from the lower inlet, and controlling the rate of fluid entry to ensure separation levels, the fluid can be sampled or removed while fluid is flowing through the chamber. During a clean up portion of the sampling process, the contaminated or undesired fluid can be ejected to the borehole while fluid continues to flow into the chamber. As the fluid transitions during flow, the sensors can be used to optimize the rate on the pump to achieve maximum ejection of contaminated fluid while maintaining the oil water transition above the lower inlet. For example, acoustic pulses can be sent from various points in the chamber and the reflective signal can measure the transition. When it is determined that the level of the water phase is reducing, or the fluid is sufficiently clean, fluid identification may occur. For example, an amount of gas or lighter fluid may be present at inlet 144 of the chamber. The presence of the gas phase will depend on the position of the separator assembly 155 in the tool string, the properties of the fluid, and the pressure maintained during the clean up phase.

Figure 13:
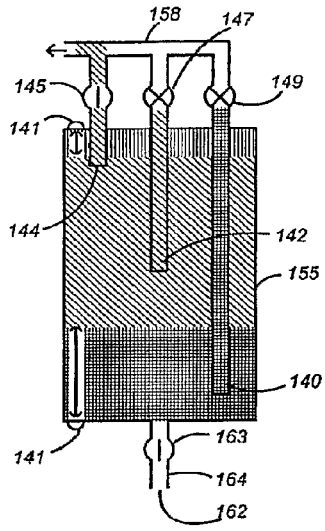
FIG. 13 illustrates a flow separator assembly according to at least one embodiment.
Figure 10:
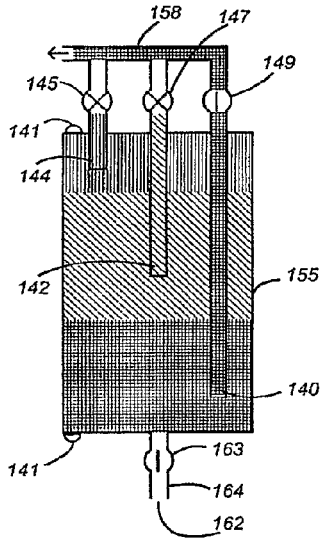
FIG. 10 illustrates a flow separator assembly according to at least one embodiment.
Figure 12:
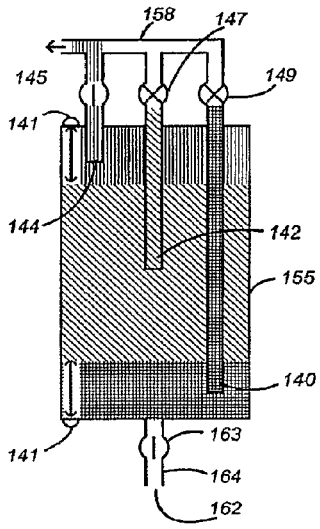
FIG. 12 illustrates a flow separator assembly according to at least one embodiment.
Figure 14:
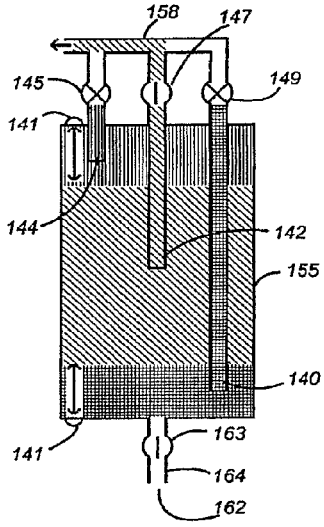
FIG. 14 illustrates a flow separator assembly according to at least one embodiment.

As shown in FIGS. 12 and 13, valves can be configured so that valve 149 is closed, and valve 145 is opened, allowing fluid or gas to be extracted from a top section of the chamber. Inlet valve 164 and valve 163 remain open, and formation fluid continues to pump into the chamber. The sensors are used to detect the presence of a gas phase, and an external sensor, as part of the fluid identification process, further measures the fluid or gas extracted. The extracted sample can be directed to a sample chamber for surface analysis. FIG. 13 illustrates the transition from the gas phase to the oil phase, and in FIG. 14, oil is removed from a generally middle section of the chamber through inlet 142 via the exit line 158 to a sample chamber. The fluid identification sensors may identify the quality of the sample. The ability to more quickly obtain a higher quality sample of oil is increased by decreasing the amount of contaminated fluid in the chamber.

FIGS. 16-19 illustrate another example flow separator assembly 155. The flow separator assembly 155 includes a main inlet 264 which leads to inlet 213 near a top portion of chamber 202, or inlet 218 near a bottom portion of chamber 202. Although the terms "top" and "bottom" are used, it should be noted it is for the purposes of relative description, and not intended to limit the orientation or placement of the chamber 202 within a borehole. Inlets 213 and 218 serve to fill chamber 202 with fluids to be separated. The flow separator further includes inlets 140, 142, 144 within the chamber 202, as discussed above. The inlets 140, 142, 144 are positioned within the chamber 202 to collect separated material. For example, inlet 140 is near a bottom portion 208 of the chamber 202 to collect the heavier material, for instance, water. Inlet 142 is at an intermediate portion 206 of the chamber 202 to collect, for example, oil. Inlet 204 is near a top portion 204 of the chamber 202 to collect, for example, the lightest material such as gas.

Figure 16:
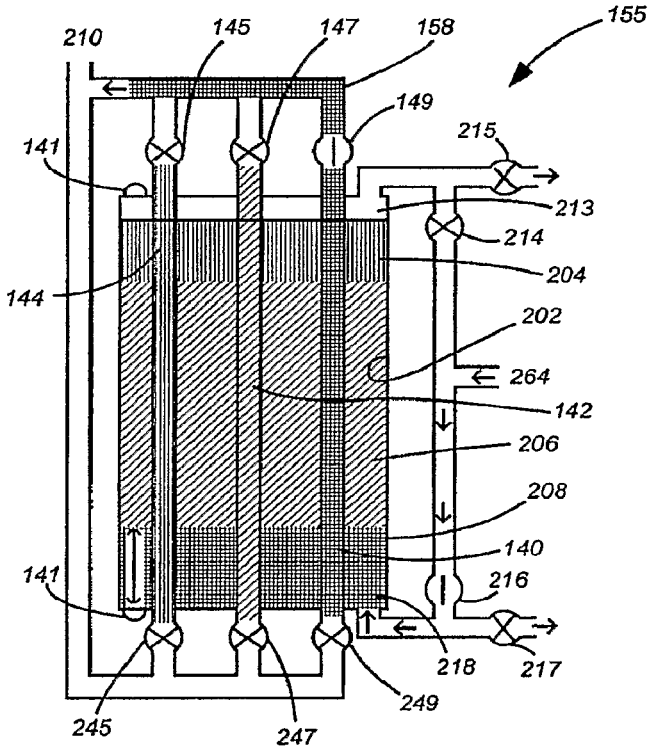
FIG. 16 illustrates a flow separator assembly according to at least one embodiment.

Valves are associated with the respective inlets to allow for removal of the collected material, for example in two different directions. For example, inlet 140 is associated with valves 149, 249, where either valve can be opened to remove the collected material. FIG. 16 illustrates a configuration where valve 149 is opened to allow material in the bottom portion 208 to be removed through outlet 210. Valves 147, 247 are associated with inlet 142, where either valve can be opened to remove the collected material in the intermediate portion 206. Valves 145, 245 are associated with inlet 144, where either valve can be opened to remove the collected material in the top portion 204 of the chamber 202. Each of the valves 149, 249, 147, 247, 145, 245 connects with outlet 210 and allows for material to flow from the chamber 202 through the outlet 210. The valves are operable to change between exiting material via the outlet 210 (the exit flow line) to a borehole and exiting collected material to a sample chamber.

Figure 17:
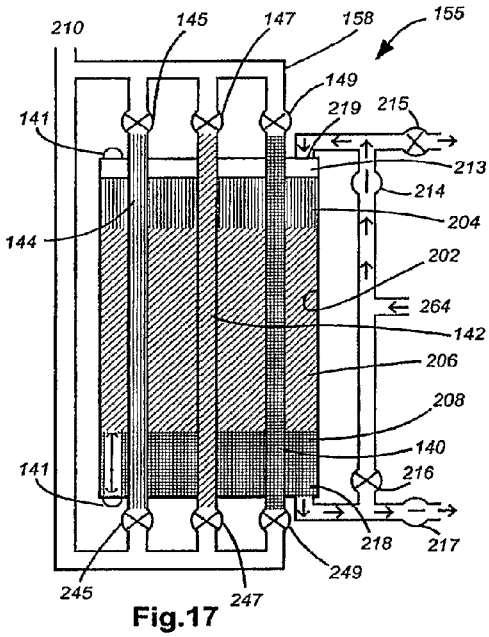
FIG. 17 illustrates a flow separator assembly according to at least one embodiment.
Figure 18:
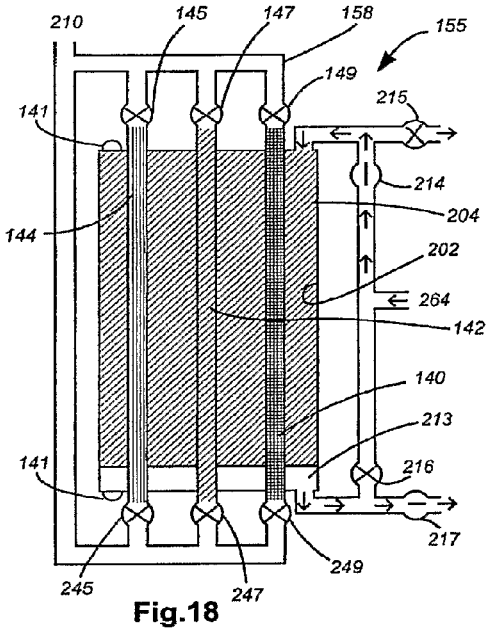
FIG. 18 illustrates a flow separator assembly according to at least one embodiment.

The flow separator assembly 155 further includes a piston 213 movably disposed within the chamber 202. The piston 213 can be used to remove all or most of the material within the chamber 202 and a new collection of material within the chamber 202 can occur. For example, fluid is introduced through line 264 and enters the chamber 202 via inlet 218. The material can be separated as discussed above, and the various valves can be opened respectively to remove certain materials, for example the gas and the water, before a sample collection of oil occurs. After this process occurs, fluid enters through 264, and passes through valve 214 as shown in FIG. 17. The fluid passes through inlet 219 and forces the piston 213 toward the opposite end of the chamber 202. As the piston 213 moves toward the bottom portion 208 of the chamber 202, the fluid within exits via 218 and passes into the borehole via open valve 217, as shown in FIGS. 17 and 18. The flow separator assembly 155 as shown in FIG. 18 is now ready to have the newly introduced fluid to be separated, for example, while fluid is continually drawn in, and drawn out, as discussed in other embodiments.

Figure 19:
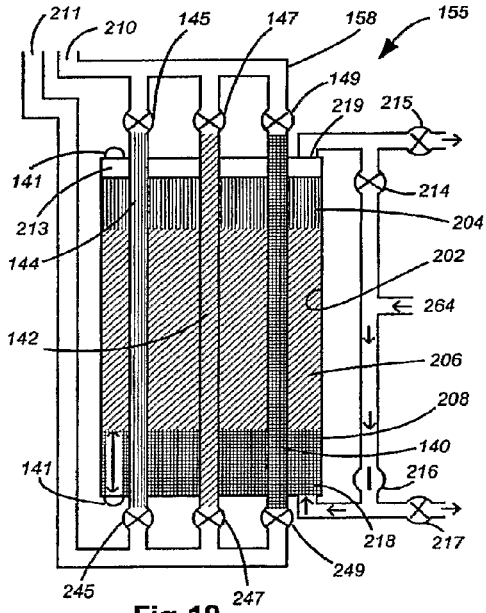
FIG. 19 illustrates a flow separator assembly according to at least one embodiment.

FIG. 19 includes the components as discussed with FIG. 16-18, and further includes a second exit 211, which allows for two portions to be sampled simultaneously. For example, the top portion 204 and the bottom portion 208 can be sampled of material, or have material removed for each portion, and exit through two different exits 210, 211. Alternatively, the exits can further be used to control the rate at which material is drawn out of the chamber 202 in the various portions 204, 206, 208. In another option, the exits 210, 211 can be configured to exit to a bore hole and/or a sample chamber. For example, one of the exits can be directed to a bore hole and one of the exits can be directed to a sample chamber.

An example of how the downhole tool is used as follows. A method includes positioning a downhole tool in a borehole having a formation therein to sample formation fluid. The method further includes establishing fluid communication between the downhole tool and the formation, passing formation fluid through a fluid separator, separating the formation fluid, flowing at least a portion of the formation fluid into the borehole from the downhole tool, and diverting at least a portion of the formation fluid to one or more sample chambers. The fluid separator includes any of the above-discussed separators. Optionally diverting at least a portion of the formation fluid to one or more sample chambers occurs while formation fluid is flowing into the borehole. Separating the formation fluid includes the above-discussed embodiments and can include separating the formation fluid using gravity.

Further options for the method are as follows. For instance, the fluid separator, the flow separator assembly, is selectively voided of undesired formation fluids, for example, by moving a piston through the separator assembly. In addition, valves can be included and used to selectively sampling fluid in different fluid phases. In another option, the one or more valves are used to change an exit flow path from the separator assembly to the borehole, to the separator to the sample chamber. The method further optionally includes using sensors to sense fluid within at least one of the fluid separator, a fluid inlet, or a fluid outlet, and identifying at least one of fluid phase or fluid level.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In view of the wide variety of permutations to the embodiments described herein, this detailed description is intended to be illustrative only, and should not be taken as limiting the scope of the invention. What is claimed, therefore, is all such modifications as may come within the scope of the following claims and equivalents thereto. Therefore, the specification and drawings are to be regarded in an illustrative rather than a restrictive sense.

What is claimed is:

1. A downhole sampling device comprising:

an inlet to be communicatively coupled with formation fluid of a subterranean formation;

a main sampling flowline coupled with the inlet;

a flow separator assembly communicatively coupled with the main sampling flowline, the flow separator assembly allowing mixed fluid phases to be separated into at least three components that can be substantially simultaneously sampled via corresponding multiple inlets while flowing formation fluid therethrough;

an exit flow line communicatively coupled between the flow separator assembly and at least one of a borehole or a sample chamber; and one or more valves operable to change between a first configuration to another configuration, in the first configuration, the one or more valves operably connectable to the exit flow line with the borehole.

2. The downhole sampling device of claim 1, wherein the one or more valves has a second configuration in which the exit flow line is operably coupled with the sample chamber.

3. The downhole sampling device of claim 1, further comprising a fluid identification sensor associated with the flow separator assembly.

4. The downhole sampling device of claim 3, wherein the fluid identification sensor is used to determine when to activate the one or more valves to fill sample chambers.

5. The downhole sampling device of claim 3, wherein the fluid identification sensor is used to determine fluid level.

6. The downhole sampling device of claim 1, wherein the flow separator assembly includes an open chamber to separate fluids using gravity.

7. The downhole sampling device of claim 1, wherein the flow separator assembly includes at least one of a cyclone or a centrifuge separator.

8. The downhole sampling device of claim 1, further comprising at least one pump, the pump associated with the inlet, the pump adapted to draw the formation fluid into the sampling device.

9. The downhole sampling device of claim 1, further comprising a movable piston within the flow separator assembly.

10. A downhole sampling device comprising:

an inlet communicatively coupled with formation fluid of a subterranean formation within a borehole;

a main sampling flowline coupled with the inlet;

means for allowing separation of mixed fluid phases to provide separated fluid comprising at least three components that can be substantially simultaneously sampled via corresponding multiple inlets while flowing formation fluid through an inlet and an outlet, the means for allowing separation communicatively coupled with the main sampling flowline; and an exit flow line communicatively coupled with at least one of the borehole or a sample chamber, and the separated fluid to exit through the exit flow line.

11. The downhole sampling device of claim 10, further comprising an expandable packer configured to permit isolating a portion of the borehole.

12. The downhole sampling device of claim 10, wherein the means for allowing separation includes an open chamber separating fluids using gravity.

13. The downhole sampling device of claim 10, wherein the multiple inlets include at least a first inlet and a second inlet, where the first inlet has a different depth than the second inlet.

14. A method for sampling a formation fluid, the method comprising:

positioning a downhole tool in a borehole within a formation;

establishing fluid communication between the downhole tool and the formation;

passing formation fluid through a fluid separator having a fluid separator inlet and a fluid separator outlet;

separating the formation fluid to provide separated formation fluid comprising at least three components that can be substantially simultaneously sampled via corresponding multiple inlets while passing the formation fluid through the fluid separator;

flowing at least a portion of the separated formation fluid into the borehole from the downhole tool; and diverting at least a portion of the separated formation fluid to one or more sample chambers.

15. The method of claim 14, wherein diverting at least a portion of the formation fluid to one or more sample chambers occurs while formation fluid is flowing into the borehole.

16. The method of claim 14, wherein the fluid separator is selectively voided of undesired formation fluids.

17. The method of claim 14, wherein separating the formation fluid includes separating the formation fluid using gravity.

18. The method of claim 14, further comprising using one or more valves and selectively sampling the formation fluid in different fluid phases.

19. The method of claim 14, further comprising operating a piston within the fluid separator to displace fluid in the fluid separator.

20. The method of claim 14, further comprising sensing fluid within at least one of the fluid separator, a fluid inlet, or a fluid outlet, and identifying at least one of fluid phase or fluid level associated with the sensed fluid.

21. The method of claim 14, further comprising using a valve and changing an exit flow path from coupling the fluid separator to the borehole, to coupling the fluid separator to the sample chamber.

22. The method of claim 14, wherein diverting at least a portion of the separated formation fluid includes diverting the portion via at least two different exit flow paths.

23. The method of claim 14, further comprising measuring at least one of fluid entering or fluid exiting the fluid separator, to determine when to activate one or more valves and when to fill the one or more sample chambers.

* * * * *